United States Patent [19]

McPherson et al.

[11] Patent Number: 4,889,061

[45] Date of Patent: Dec. 26, 1989

[54] REFRACTORY BIN FOR PIT BURNING

[75] Inventors: Donald L. McPherson; Tony L. McPherson, both of Tifton, Ga.

[73] Assignee: McPherson Systems, Inc., Tifton, Ga.

[21] Appl. No.: 305,420

[22] Filed: Feb. 1, 1989

[51] Int. Cl.[4] ..... F23M 5/00

[52] U.S. Cl. ..... 110/336; 52/486; 52/511

[58] Field of Search ..... 110/336, 338, 339; 432/238; 52/486, 511

[56] References Cited

U.S. PATENT DOCUMENTS

| | | | |
|---|---|---|---|
| 1,657,453 | 1/1928 | Boyd | 52/486 |
| 1,990,185 | 2/1935 | Hosbein | 52/486 X |
| 4,249,888 | 2/1981 | Werych | 110/336 X |
| 4,705,475 | 11/1987 | Coates | 110/336 X |
| 4,811,539 | 3/1989 | Menchetti | 52/511 X |

*Primary Examiner*—Edward G. Favors

*Attorney, Agent, or Firm*—Rodgers & Rodgers

[57] ABSTRACT

A refractory lined pit burning bin for containing trees, branches, stumps and other combustible material to be burned includes rigid wall frames forming three walls of a rectangular bin having doors which constitute a fourth wall and in which the ends of the wall frames are disjointably connected at the bin corners, a plurality of generally rectangular refractory panels disposed about the inner parts of the rigid wall frames and doors to form a lining for the bin, and a plurality of brackets secured to the outer surface of each refractory panel and arranged disjointably to engage the rigid wall frames whereby the refractory panels may be installed and removed from inside the bin.

15 Claims, 3 Drawing Sheets

REFRACTORY BIN FOR PIT BURNING

TECHNICAL FIELD

This invention relates to a bin having a refractory lining and which receives material for burning such as tree limbs, stumps and other debris.

BACKGROUND ART

U.S. Pat. No. 4,739,712 issued Apr. 26, 1988 and owned by the assignee of this invention discloses apparatus for supplying an air curtain to a pit containing combustible material such as stumps, tree limbs, trees and other debris to be burned. The apparatus of U.S. Pat. No. 4,739,712 is usable in connection with a pit which simply constitutes an excavated hole in the ground or may be used in conjunction with this invention.

Material to be burned normally is deposited in a debris burning pit by heavy apparatus such as front end loaders and the like. Such loading devices may cause the walls of an earthen pit to collapse and to partially fill the pit. If burning is in process during loading operations a wall collapse interferes with efficient burning and leads to time consuming and expensive clean-up operations.

SUMMARY

According to this invention in one from, a refractory bin is provided and includes rigid wall structure which is readily disjointable at its corners and which includes removable refractory panels about its inner surface to form a heat resistant lining for the bin, the frame structure and refractory panels being mechanically strong so that the weight of machines such as front end loaders delivering debris to be burned in the bin will not cause cave in of the bin walls. The walls are arranged in a horizontal rectangular cross sectional configuration and one wall constitutes doors whereby access to the interior of the bin may be had by vehicles for removing ash following a burning operation. The fact that the wall frames are disjointably connected at their corners together with the fact that the refractory panels are disjointably mounted to the interior surfaces of the frame accounts for quick and efficient assembly and disassembly of the bin at a work site.

BEST MODE OF CARRYING OUT THE INVENTION

Figure 1:
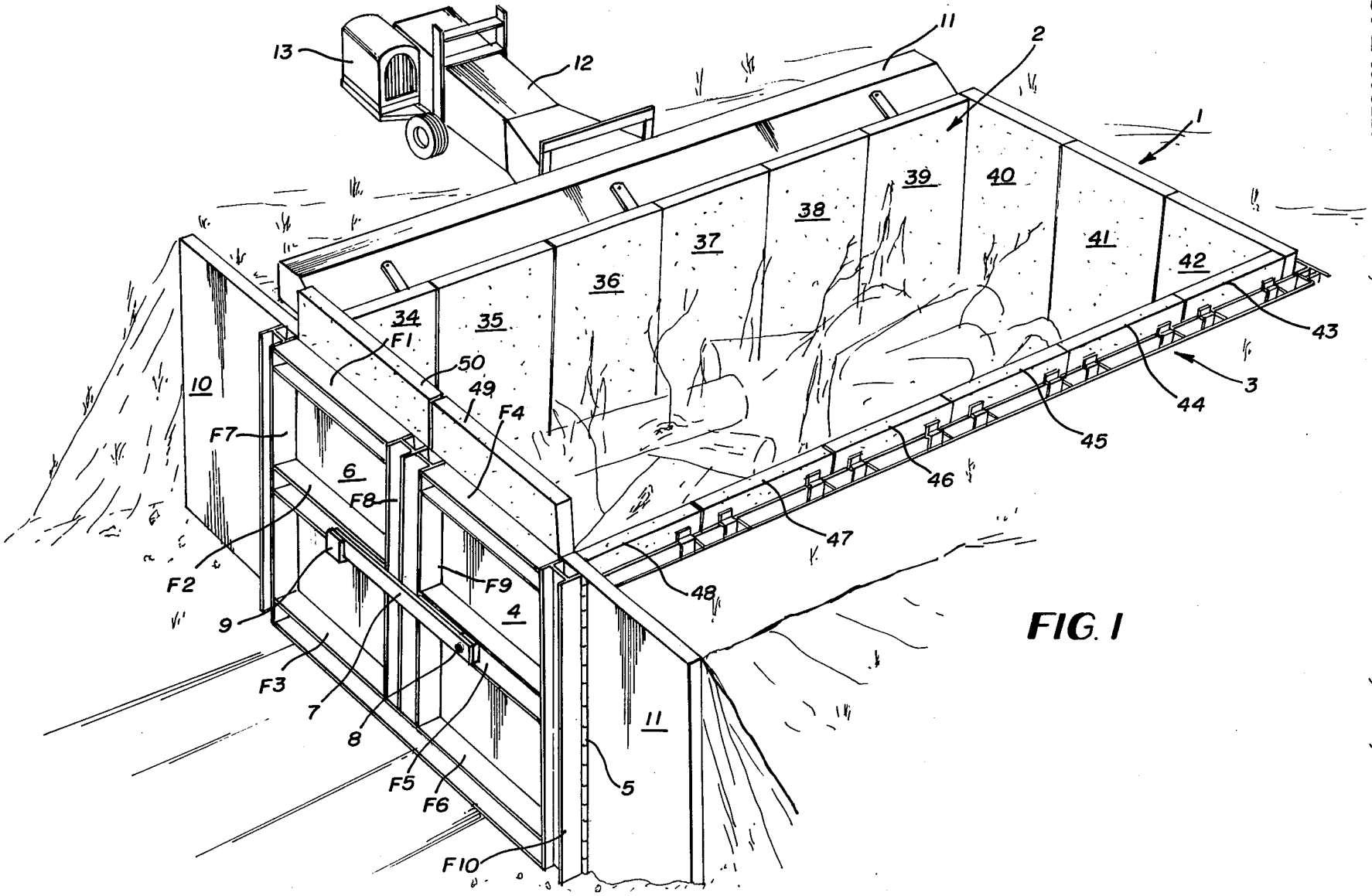
FIG. 1 is an overall perspective view of a refractory bin formed according to this invention which shows the bin in conjunction with air curtain apparatus for facilitating efficient burning.

With reference to FIG. 1, the numeral 1 generally designates an end wall of the bin while the numerals 2 and 3 generally designate side walls of the bin. Door 4 is mounted by hinge 5 to an end of side wall 3 while door 6 is hingedly mounted to an end of side wall 2 by hinge structure not shown in FIG. 1. A locking element 7 is pivotally mounted at pivot 8 to door 4 and is engageable with a latch 9 secured to door 6 so as to hold doors 4 and 6 in the closed position.

As shown in FIG. 1, the bin is partially immersed in earth and a pair of wing walls 10 and 11 are fixedly secured to the ends of side walls 2 and 3 so as to retain earth in a position away from the swing area of the doors 4 and 6 and so as to permit access to the inside of the bin by vehicles for removing ash.

An air curtain is supplied to the bin by means of the air curtain apparatus having a nozzle 11 mounted on an air supply tube 12 to which air is supplied by a conventional fan not shown in the drawings but which is driven by suitable means such as a conventional gasoline or diesel engine 13 all as disclosed and claimed in U.S. Pat. No. 4,739,712.

Figure 6:
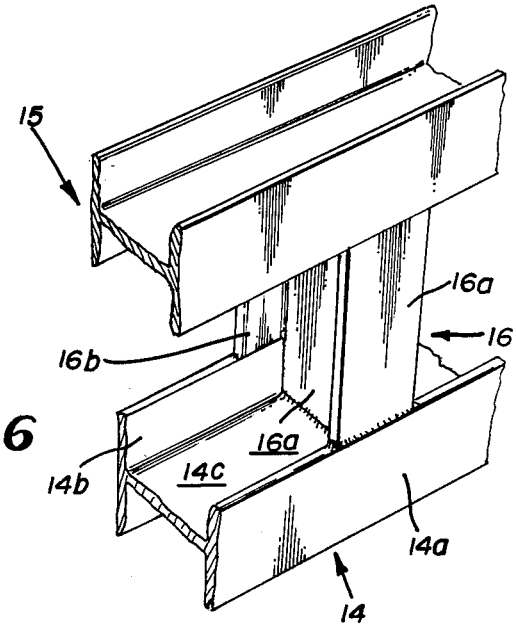
FIG. 6 is an enlarged fragmentary view of a vertical reinforcing post together with horizontal I-beam frame elements reinforced by the vertical post.
Figure 10:
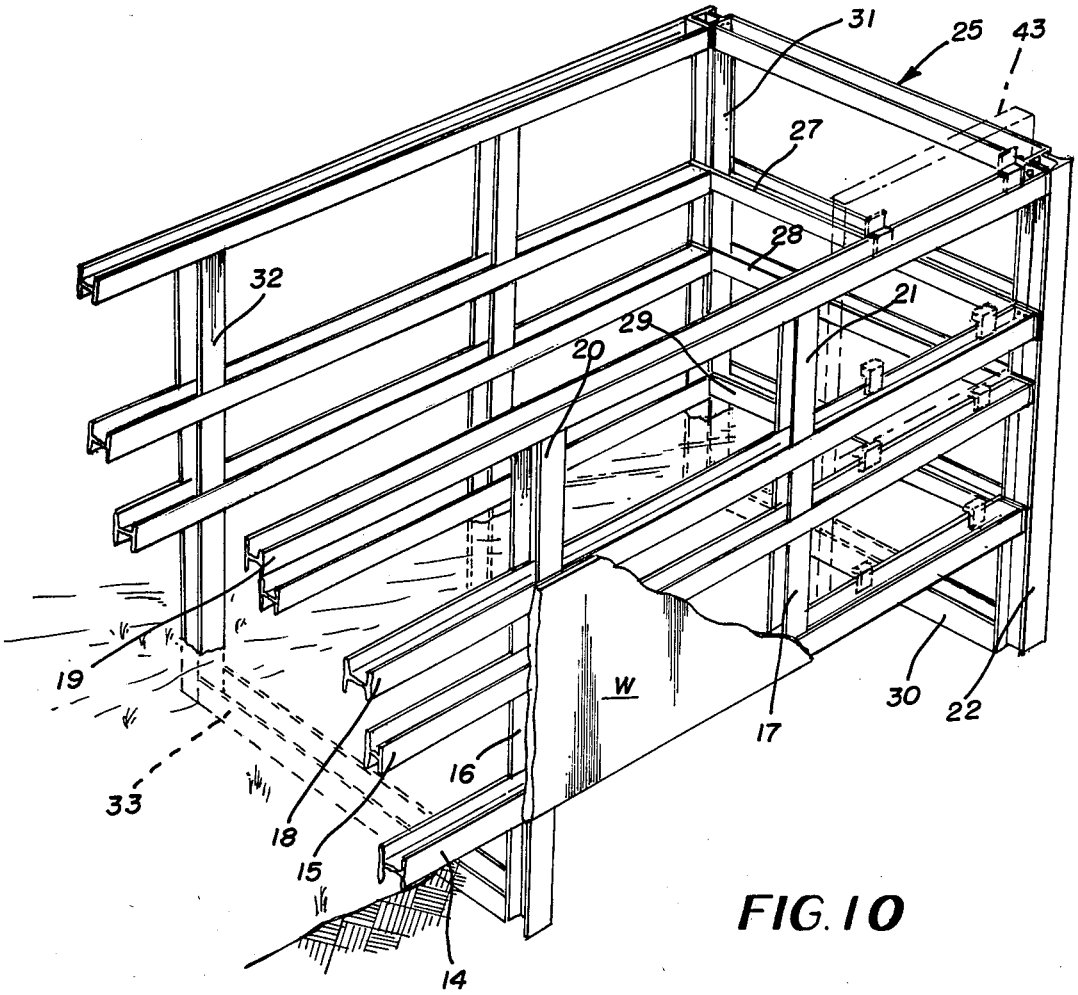
FIG. 10 is a perspective view generally similar to FIG. 1 but which shows the rigid frame structure of the side and end wall sections at one end of the bin.

As is best shown in FIG. 10, a lower pair of I-beams 14 and 15 are horizontally disposed and are separated by vertical reinforcing posts 16 and 17 and serve to support a lower tier of refractory panels. Upper horizontal I-beams are designated by the numerals 18 and 19 and serve to support an upper tier of refractory panels. These upper horizontal beams are separated by reinforcing posts 20 and 21. In FIG. 6 reinforcing post 16 is shown with its flanges 16*a* and 16*b* welded respectively to the flanges 14*a* and 14*b* of horizontal beam 14. The web 16*a* of reinforcing post 16 is welded to the web 14*c* of horizontal beam 14 and to the inner surfaces of flanges 14*a* and 14*b*. For some applications of the invention, it may be desirable to weld only the flanges of a vertical reinforcing post to the flanges of the horizontal beam and for other applications welding only the web of the vertical reinforcing post 16 to the web of the horizontal beam may be desirable and adequate.

As is indicated generally in FIG. 10, horizontal beams 14, 15, 18 and 19 are secured at one end to corner post 22. The corner structure is best shown in enlarged FIG. 5 where a coupling plate 23 is shown secured as by welding to the ends of the flanges 19*a*, 19*b* and web 19*c* of horizontal beam 19. In like fashion, a coupling plate 24 is welded to the edges of flanges 22*a* and 22*b*. Coupling plates 23 and 24 are secured together in flat face contacting relation by suitable bolts not shown but which are inserted into the apertures such as 23*a* in coupling plate 23 and 24*a* in coupling plate 24. A horizontal end beam 25 is provided with a coupling plate 26 welded to the ends of flanges 25*a* and 25*b* and to web 25*c*. Suitable bolts not shown interconnect coupling panel 26 with the web 22*b* of post 22 by means of bolts inserted through apertures such as 26a and corresponding aperture 22c.

Figure 2:
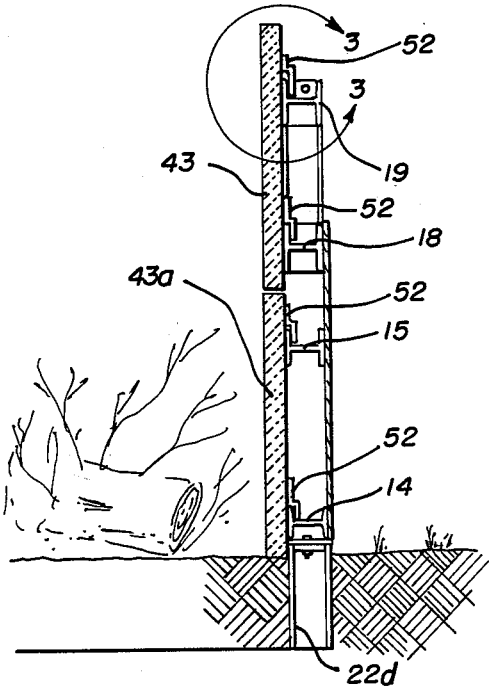
FIG. 2 is a cross section of one wall of the bin shown in FIG. 1.
Figure 3:
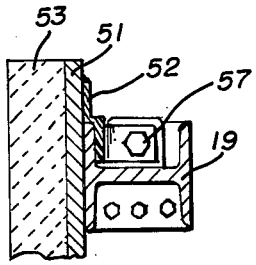
FIG. 3 is an enlarged view of the top portion of FIG. 2.

Of course the opposite side from that described in connection with FIG. 10 is of identical construction and a detailed discussion thereof is not necessary. Suffice it to say that the end of horizontal beams of the end wall as shown in FIG. 10 include upper pair of horizontal beams such as 25, 27 and a lower pair of horizontal beams 28 and 29. A horizontal beam 30 interconnects the lower end of post 22 with the lower end of corner post 31 by structure such as that shown in a part of FIG. 5. The lower end of post 20 is interconnected with the lower end of post 32 by means of a horizontal beam embedded below ground level and designated by the numeral 33. Beam 33 is connected with the lower ends of posts 20 and 32 by a part of the structure shown in FIG. 5 as is obvious. Depending on local topography it may be desirable to extend a post such as 22 with a part 22a as shown in FIG. 2 in which case coupling plates are secured to the adjacent ends of post 22 and of extension 22d and bolted together as is obvious from FIG. 2.

Figure 5:
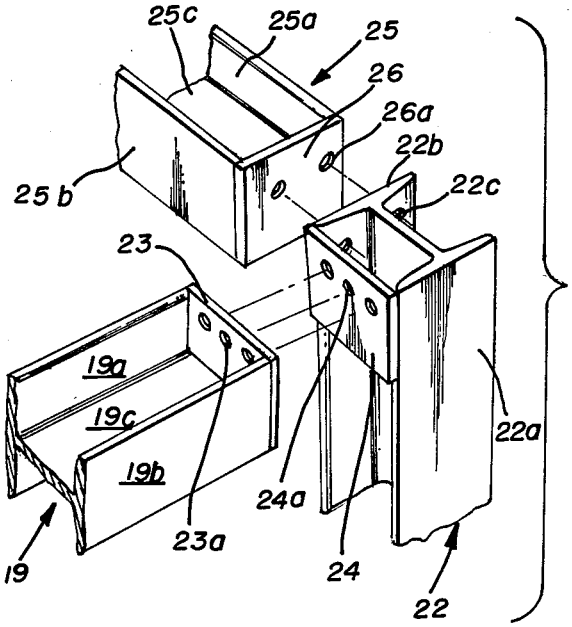
FIG. 5 is an exploded view of the corner structure of the bin.

The horizontal I-beams F1-F6 and the vertical I-beams F7-F10 which are parts of doors 4 and 6 are interconnected in a manner which is obvious from FIG. 5 and the mounting of refractory panels 49 and 50 may be effected in any convenient manner.

From the description of the frame structure, it is apparent that assembly of the walls is greatly simplified due to the fact that the corners are interconnected by bolts which facilitate assembly and disassembly according to one feature of this invention.

For the purpose of insulating the structural I-beam members such as are shown in FIG. 10 from the intense heat of combustion, refractory panels are provided. In FIG. 1, an upper tier of these panels are designated by the numerals 34–50 inclusive.

Figure 7:
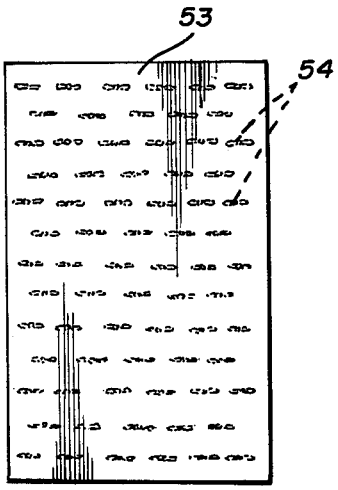
FIG. 7 is an inside view of a refractory panel formed according to a feature of this invention.
Figure 8:
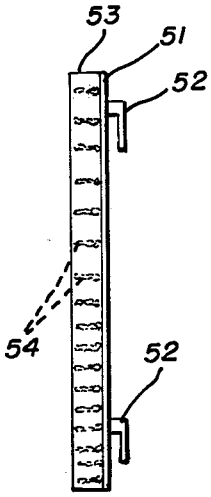
FIG. 8 is a cross sectional view of FIG. 7.
Figure 9:
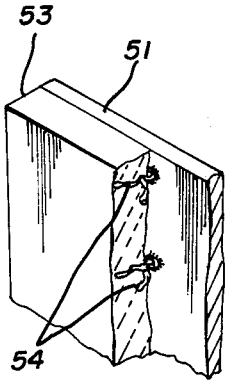
FIG. 9 is a fragmentary perspective view with parts broken away of FIGS. 7 and 8 which shows the relationship of the parts which constitute the refractory and reinforcing parts of the structure of FIGS. 7 and 8.

The details of construction of the refractory panels are best shown in FIGS. 7, 8 and 9. As is apparent in these figures, a metallic backing plate 51 is provided with brackets 52 which are secured as by welding to the metal backing plate 51. Refractory material 53 is secured to metallic backing plate 51 by a plurality of securing devices 54 which are welded or otherwise secured to the inner surface of metallic backing plate 51. Refractory material is formed when in a viscous state in a rectangular frame disposed about plate 51 and which is removed once the viscous material hardens.

Figure 4:
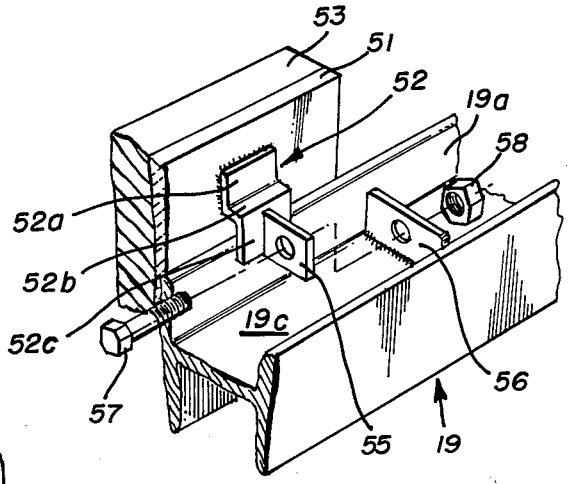
FIG. 4 is an enlarged view of a fragment of an I-beam forming a part of a wall frame together with a bracket secured to the outer surface of a fragmentary part of a refractory panel together with anchoring means for securing the refractory panel in position relative to the wall frame.

As is shown in FIG. 4, brackets such as 52 include a portion 52a which is welded to the metallic plate 51 together with a horizontal part 52b which overlies the flange 19a of horizontal beam 19 together with a vertical part 52c which is disposed alongside the inner surface of flange 19a. A first apertured tab 55 is secured to the part 52c of bracket 52 and a second apertured anchoring tab 56 is secured as by welding to the web 19c of beam 19.

Anchoring tabs 55 and 56 as is obvious from FIG. 4 are held in close proximity to each other by the bolt 57 and its associated nut 58 as is obvious.

The assembly of the pit structure is greatly simplified according to this invention because the horizontal support beams are secured to corner posts by bolts which facilitate assembly and disassembly. In addition, the refractory panels are simply mounted in place by arranging the brackets to overlie the upper supporting edge of a flange such as 19a of beam 19. Since the refractory panels are arranged in two horizontal tiers in the side and end wall, the anchoring of a panel such as 43 securely holds the lower associated refractory panel 43a in position since upward movement of panel 43a is prevented due to the close proximity of its upper edge to the lower edge of panel 43 as is shown in FIG. 2. Of course all of the lower tier of refractory panels are held in position as represented in FIG. 2.

In case repair of a refractory panel is needed, such panels may simply be removed from the inside of the bin and exterior earth need not be disturbed.

For some applications of the invention it may be desirable to utilize a wall panel such as is indicated in fragmentary form in FIG. 10 at W.

By the invention, the use of concrete footings and retaining walls is completely eliminated due to the mechanical strength of the supporting I-beams and to the mechanical strength of the backing plates such as 51 of the refractory panels. Of course the refractory material secured to the inner surface of backing plates such as 51 insulates the heat of combustion sufficiently so that the frame and refractory panels remain sufficiently strong. Furthermore, cave-ins are prevented altogether.

We claim:

1. A refractory bin of generally rectangular horizontal cross sectional configuration and having wall structures each comprising an upper and a lower pair of elongated horizontal vertically spaced generally parallel support beams each having a vertical flange defining a support edge along its upper surface, a first generally rectangular refractory panel arranged with its lower edge at the bottom of the bin and with its outer surface in flat face contacting relation with the vertical flanges of said lower pair of support beams, a plurality of brackets each having a horizontal part and a vertical part and being secured to the outer surface of said first refractory panel at least two of which brackets are arranged respectively to overlie the support edges of the vertical flanges of said lower pair of support beams, a second generally rectangular refractory panel arranged with the lower edge immediately above the upper edge of said first refractory panel, a second plurality of brackets each having a horizontal part and a vertical part and being secured to the outer surface of said second refractory panel, at least two of which brackets are arranged respectively to overlie the support edges of the vertical flanges of said upper pair of support beams, and anchoring means for securing at least one of said second plurality of brackets to its associated support beam.

2. A refractory bin according to claim 1 wherein each of said support beams comprises a horizontal web panel and a pair of vertical flange panels integral with the outer edges of said web panel and forming an I-beam.

3. A refractory bin according to claim 1 wherein each of said refractory panels comprises an outer metallic panel to the inner surface of which a layer of refractory material is secured.

4. A refractory bin according to claim 1 wherein four brackets are secured to each of said refractory panels and arranged in upper annd lower pairs, each pair being engageable with the vertical flanges of vertically spaced support beams.

5. A refractory bin according to claim 3 wherein a plurality of securing devices are affixed to the inner surface of said metallic panel and arranged in embedded relation with said layer of refractory material.

6. A refractory bin according to claim 1 wherein each of said wall structures includes two pairs of vertically spaced I-beams.

7. A refractory bin according to claim 1 wherein said anchoring means comprises a first apertured tab secured to said one of said second plurality of brackets, a second aperture tab secured to the associated support beam in close proximity to said first apertured tab, a bolt disposed within the apertures in said tabs, and a nut associated with said bolt for securing said tabs against separating movement.

8. A refractory bin according to claim 7 wherein said first apertured tab is secured to said vertical part of the associated one of said brackets and wherein said second apertured tab is secured to the web of the associated support beam.

9. A refractory bin according to claim 1 wherein a first coupling plate is secured to an end of a horizontal support beam in one wall of the bin and disjointably coupled with a flange of a vertical I-beam forming a corner post and wherein a second coupling plate is secured to the adjacent end of a horizontal support beam in another wall of the bin and disjointably coupled with a third coupling plate secured to the outer edges of the flanges of said corner post.

10. A refractory bin according to claim 1 wherein a vertically disposed I-beam post forms a corner junction for end and side wall structures and wherein a pair of coupling plates are secured respectively to adjacent ends of corresponding side and end support beams and wherein a flange of said I-beam post is bolted to one of said pair of coupling plates and wherein a third coupling plate is secured to the adjacent flanges of said I-beam post and bolted to the other of said pair of coupling plates.

11. A refractory bin according to claim 1 wherein vertical reinforcing posts are interposed between horizontal beams and secured thereto.

12. A refractory bin according to claim 11 wherein said vertical reinforcing posts and said horizontal support beams are in the form of I-beams and wherein the flanges of said vertical reinforcing posts are secured to the flanges of said horizontal support beams.

13. A refractory bin according to claim 12 wherein the webs of said vertical reinforcing posts are secured to the webs of said horizontal support beams.

14. A refractory bin according to claim 1 wherein one wall of the bin comprises hingedly mounted swinging doors each formed of interconnected outer horizontal and vertical support beams, inner panels of refractory material and disjointable locking means for holding said doors closed 15. A refractory bin according to claim 14 wherein a pair of wing walls extend outwardly from adjacent the outer portions of said doors for preventing earth slides from interfering with opening of said doors.

* * * * *